US008172704B2

(12) United States Patent
Horkan

(10) Patent No.: US 8,172,704 B2
(45) Date of Patent: May 8, 2012

(54) FOOTBALL CARRYING TRAINING AID

(76) Inventor: Noel P. Horkan, New Windsor, NY (US)

( * ) Notice: Subject to any disclaimer, the term of this patent is extended or adjusted under 35 U.S.C. 154(b) by 0 days.

(21) Appl. No.: 12/685,038

(22) Filed: Jan. 11, 2010

(65) Prior Publication Data

US 2011/0172033 A1 Jul. 14, 2011

(51) Int. Cl.
*A63B 69/00* (2006.01)

(52) U.S. Cl. ..... 473/438; 473/450; 473/458

(58) Field of Classification Search ..... 473/450, 473/458, 464, 422, 438, 424; 206/315.1, 206/315.9
See application file for complete search history.

(56) References Cited

U.S. PATENT DOCUMENTS 4,247,117 A * 1/1981 Reichert ..... 473/424
5,407,111 A * 4/1995 Lanouette et al. ..... 224/579
5,443,576 A * 8/1995 Hauter ..... 473/424
6,352,484 B1 * 3/2002 Killion ..... 473/424
7,275,669 B1 * 10/2007 Aikens ..... 206/315.9
2006/0183570 A1 * 8/2006 Gamsaragan et al. ..... 473/424
2008/0105576 A1 * 5/2008 Brown ..... 206/315.9
2009/0075763 A1 * 3/2009 Wu et al. ..... 473/424

* cited by examiner

*Primary Examiner* — Mitra Aryanpour
(74) *Attorney, Agent, or Firm* — James Russell Claybrook

(57) ABSTRACT

A device which aids the training of football carriers, specifically backfield players, in the desired ball carrying and retaining posture, comprising a belt worn around the waist of the player, an attached cradle or flap hanging from the belt, and a football supported by the cradle or flap, which in combination assist in teaching a player to assume a crouching posture when running while carrying the football towards opposing players, and to protect the football from opposing players in a pocket formed by the player's arms. The training aid also encourages the player to hold the shoulders squared in a horizontal orientation, to form and maintain the protective pocket for the football in the most effective manner.

19 Claims, 3 Drawing Sheets

FOOTBALL CARRYING TRAINING AID

BACKGROUND OF THE INVENTION

This invention relates to a training aid and, more particularly, to a belt worn around the waist of the player, an attached cradle or flap hanging from the belt, and a football supported by the cradle or flap, which in combination assist in teaching a player to assume a crouching posture when running while carrying the football towards opposing players, and to protect the football from opposing players in a pocket formed by the player's arms.

The desired posture of a football player who is running with the football, and specifically of a backfield player approaching the opposing line while carrying the football, is a crouching posture with the football cradled by the arms in a protective pocket, which lowers the player's center of gravity, reduces the likelihood of the player being forced off-balance or injured, reduces the likelihood of the football being dislodged from the player's control by the opposing players and increases the likelihood that the ball carrier will succeed in advancing the field position of the football. The desired posture is also to hold the shoulders squared in a horizontal orientation, to form and maintain the protective pocket for the football in the most effective manner.

The natural posture of an untrained player in running while carrying a football is a nearly upright position, which allows maximum stride length, but which also increases the vulnerability of the player to blocking and tackling by opposing players, and decreases control of the football by the ball carrier. Assuming the desired crouching posture by a football carrier, and forming and maintaining the protective pocket for the football, requires training, and the use of the device as described herein provides immediate reinforcement of the desired posture and ball-carrying technique of the player, and facilitates the efforts of coaches and trainers.

Tracy (U.S. Pat. No. 6,875,135) discloses a device designed to improve the posture of football players, by encouraging the desired crouching posture but the described device is elaborate, may restrict the player's ability to run, and does not aid in ball-carrying techniques.

Meatheringham (U.S. Pat. No. 4,211,017) and others disclose devices designed to encourage desired positioning of football players, but do not provide the combination of aids to training needed by running backs, as described above.

Killion (U.S. Pat. No. 6,352,484) describes a soccer training apparatus, comprising a waist belt and an elastic tether line connecting the belt with a ball holder. The ball holder comprises a ball cradle portion and a locking arm portion. The waist belt is fastened by hook and loop fasteners located on overlapping belt ends, and the elastic tether line attached to the belt allows the ball and ball holder to rest on the playing surface. In use, the user kicks the ball and ball holder, which return to the user after each kick. The apparatus of Killion provides a ball and ball cradle on the playing surface, designed to aid in kicking training for soccer players, but does not enable training for ball carrying.

Hauter (U.S. Pat. Nos. 5,669,837, 5,586,760 and 5,443,576) describes a soccer training apparatus. The apparatus has a mesh soccer net sized and configured for encapsulating a soccer ball and loosely holding the soccer ball within the mesh soccer net enabling the encapsulated soccer ball to freely rotate within. The mesh net is connected to a waist belt by a cord, leaving the mesh soccer net carrying the soccer ball suspended from the waist belt. These inventions are adapted for training players in kicking and foot dribbling soccer balls, but do not enable training for ball carrying as the current invention provides.

Forrest, Sr. (U.S. Pat. No. 5,611,532) describes a wiffle football provided with a tether having a free end attachable to the user. This apparatus does not enable training for ball carrying.

Guerriero (U.S. Pat. No. 6,012,993) describes an athletic training harness including a waist belt having a pair of adjustable thigh straps, and having multiple connectors on the belt, each adapted to connect to a tether. This apparatus does not provide for supporting a ball from the waist belt, or enabling training for ball carrying.

BRIEF SUMMARY OF THE INVENTION

In response to the needs described I have invented a training aid in the form of a cradle into which a football can be securely inserted, said cradle being attached to a belt to be worn around the waist of a football player, specifically a football player training as a backfield runner. The device of the invention is designed to encourage the player to assume a crouching rather than an upright posture while carrying the football, to hold the football in the desired location at his abdomen, to form and maintain the desired protective pocket for the football by the desired placement of the player's arms and hands in relation to the football and to maintain his shoulders in a horizontal, squared-off orientation while carrying the football.

In a second embodiment, the training aid is in the form of a football attached to a flexible flap, said flap being attached to a belt to be worn around the waist of a football player, specifically a football player training as a backfield runner. The second embodiment of the invention is designed to be used in the same manner as the first embodiment.

A further object of this invention is to provide a training aid, as aforesaid, which does not interfere with normal game play, specifically the holding of the football while running towards an opposing player or line of players.

Another object of this invention is to provide a training aid, as aforesaid, which is simple in design, readily used and readily portable.

Other objects and advantages of this invention will become apparent from the following description taken in connection with the accompanying drawings, wherein is set forth by way of illustration and example, an embodiment of this invention.

DETAILED DESCRIPTION OF THE INVENTION

Figure 1:
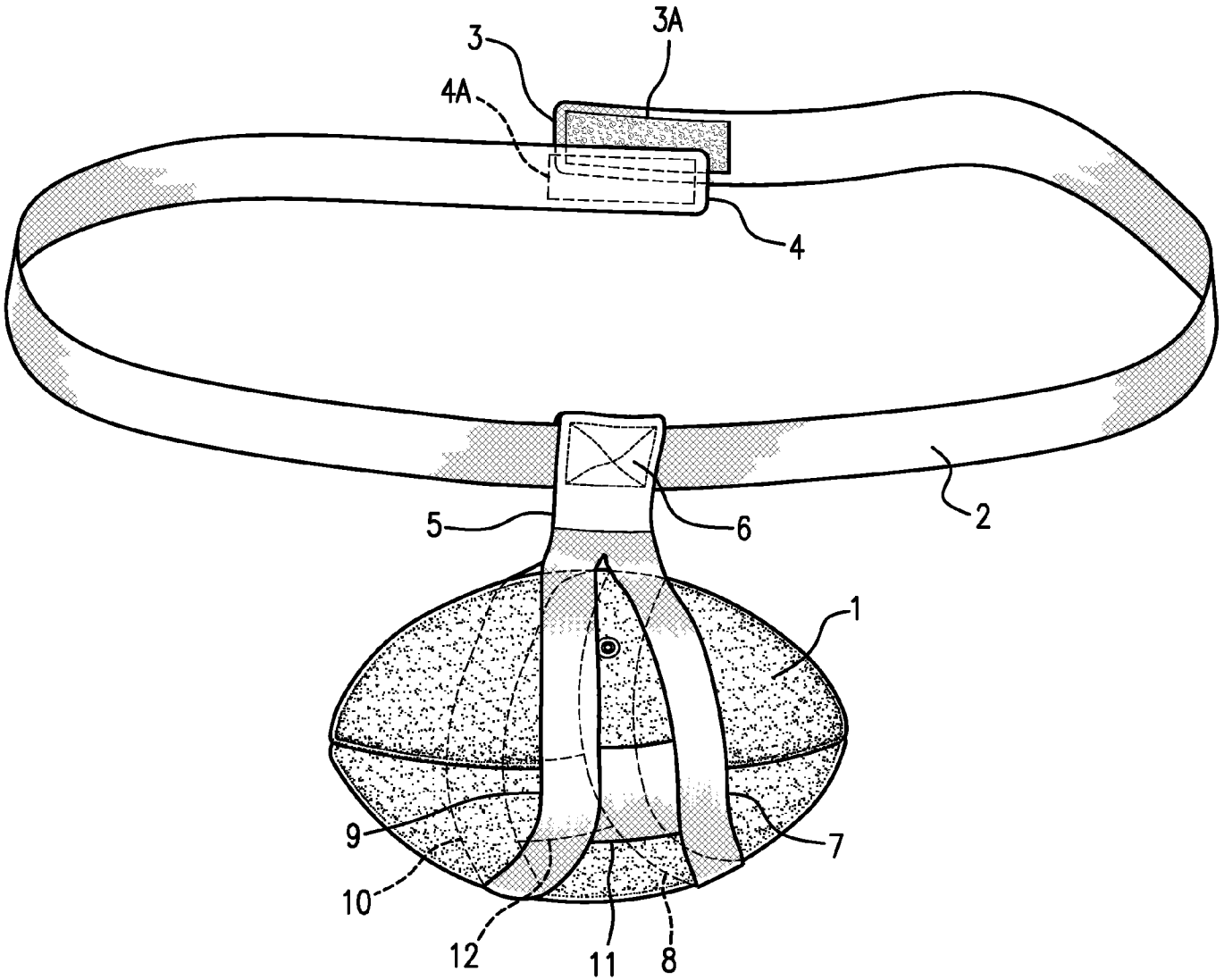
FIG. 1 is a perspective view showing a standard, regulation American football supported in a football cradle, said cradle supported by a cradle support attached to a support belt having two ends having fastening means.

Turning more particularly to the drawings, FIG. 1 shows a flexible football cradle support belt 2 designed to be worn around the waist of a football player being trained to carry a football in a desired manner, said belt having first 3 and second 4 ends and first 3A and second 4A fasteners, said fasteners being designed to fasten said belt around said player's waist. FIG. 1. further shows said belt 2 supporting a cradle support 6, said cradle support attached to a football support cradle 5, said support cradle supporting a standard, regulation American football 1, having two tapered ends and a central ball section progressively enlarged between the two ends. FIG. 1 further shows said football 1 inserted into said football support cradle 5, said cradle having two football support straps, the first said support strap having front 7 and rear 8 sections and the second said support strap having front 9 and rear 10 sections, first said front 7 and rear 8 sections attached to said cradle support 6 to form a first loop, second said front 9 and rear 10 sections attached to said cradle support 6 to form a second loop, said first and second loops securely supporting said football 1. FIG. 1 further shows front 11 and rear 12 connecting straps having first and second ends, said first end of front connecting strap 11 attached to said first front support strap section 7, said second end of front connecting strap 11 attached to said second front support strap section 9, said first end of rear connecting strap 12 attached to said first rear support strap section 8, said second end of rear connecting strap 12 attached to said second rear support strap section 10. Said football support cradle allows said football to be raised to the level of the abdomen of the player, but does not allow said football to be raised above the level of the abdomen of the player.

Figure 2:
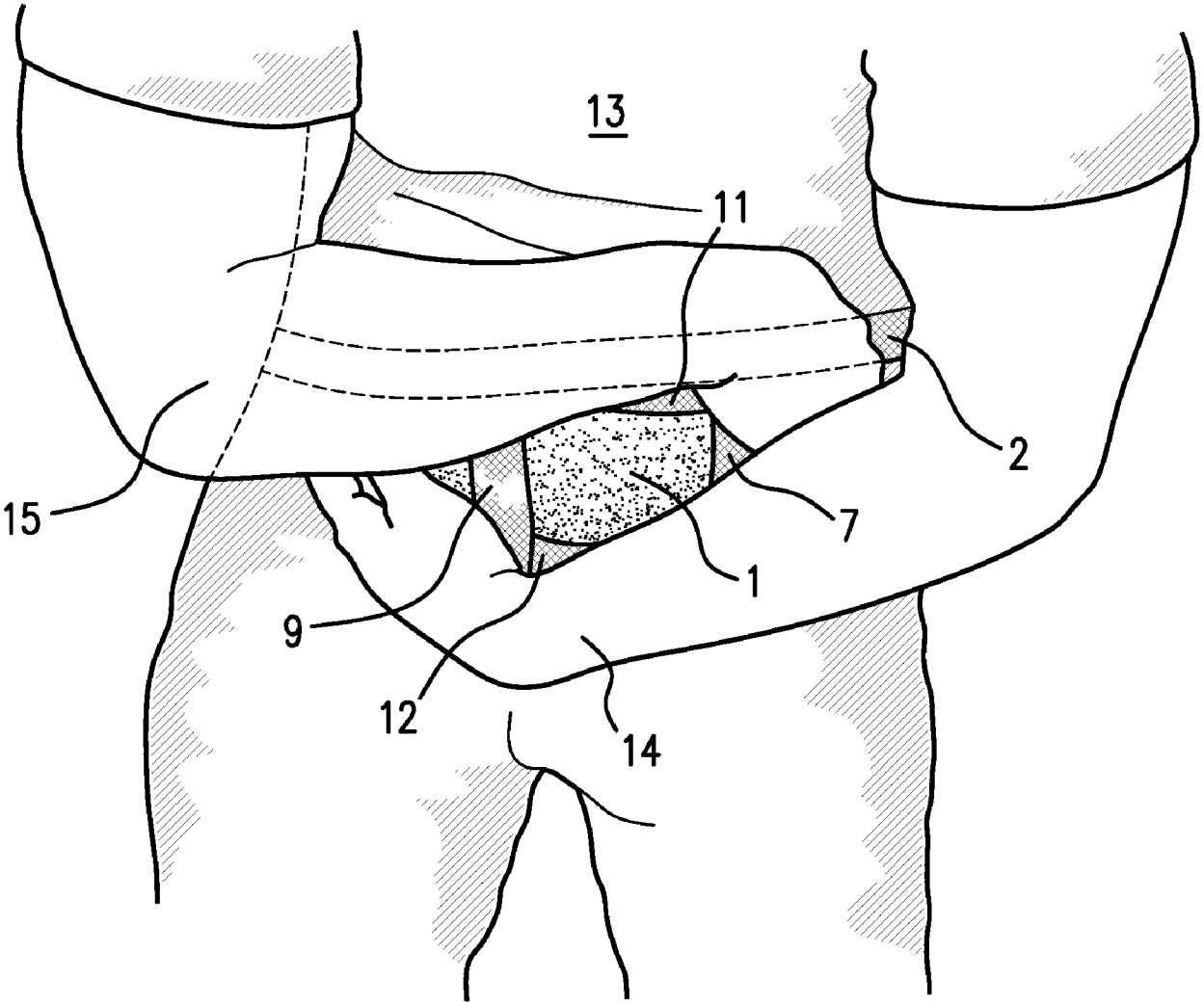
FIG. 2 is a perspective view showing a football player, the support belt encircling the waist of the player, the football support cradle and the football supported by the arms of the player, the first arm of the player beneath the football, the second arm of the player above the football, and the two hands of the player holding the two ends of the football.

FIG. 2 shows a football player 13, said support belt 2 encircling waist of said player, said football 1, said first 7 and second 9 football support straps, said front 11 and rear 12 connecting straps, a first 14 and second arm 15 of said player holding said football 1 and said football cradle at the level of the player's abdomen, said first arm 14 beneath said football and said second arm 15 above said football, said first and second arms and player's hands holding said football in a secure pocket.

Figure 3:
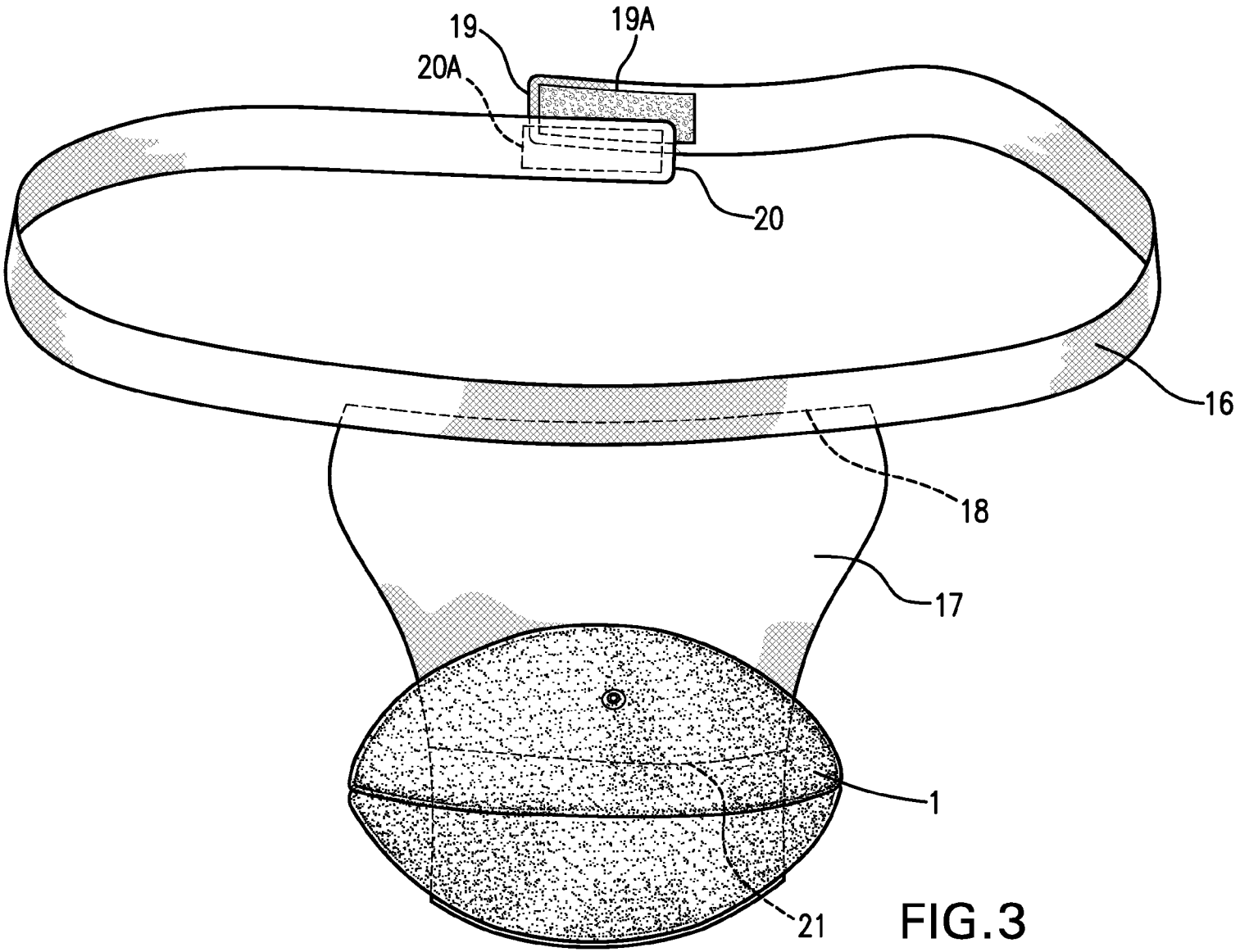
FIG. 3 is a perspective view showing a flexible flap having front and rear surfaces and top and bottom ends, a standard, regulation American football attached to the front surface of the flexible flap, the larger axis of the football having a horizontal orientation, the top end of the flexible flap attached to a flexible belt having first and second fasteners.

FIG. 3 shows a standard, regulation American football 1, a flexible flap 17 having front and rear surfaces, said football 1 attached to the front surface of said flap 17 by a non-removable attachment 21, said flap supported by a waist belt 16 having front and rear surfaces and first 19 and second 20 ends, having first 19A and second 20A fasteners, said flap 17 attached to rear surface of said belt by non-removable attachment 18.

The fasteners 3A and 4A preferably have complementary hook and loop elements. Fasteners 19A and 20A preferably have complementary hook and loop elements.

The first fasteners 3A, 19A may have loop type fastening elements and the second fasteners 4A, 20A may have complementary hook type fastening elements.

It is also understood that the first fasteners 3A. 19A may have hook type fastening elements and the second fasteners 4A, 20A may have complementary loop type fastening elements.

The fasteners 3A and 4A, and 19A and 20A, may have conventional buckle fastener or snap latch design, or other secure conventional fastener design.

The belt 2, 16 preferably is made of a strong, flexible synthetic polymer fabric, but may be made of leather or other strong, flexible material.

The cradle support 6 preferably is made of a strong, flexible synthetic polymer fabric, but may be made of leather or other strong, flexible material. The cradle support 6 preferably has front and rear portions forming a loop adapted to insertion of the belt 2, providing removable attachment of the belt 2 to the cradle support 6. The cradle support 6 may optionally be non-removably attached to the belt 2, by conventional attachment means including stitching, adhesive or other attachment means.

The front and rear football support strap sections 7, 8, 9, 10 preferably are made of strong, elastic, flexible polymer material, but may be made of any strong, flexible material. The first support strap sections 7, 8 preferably are made of a single, continuous, elastic, flexible material; optionally, said first front support strap section 7 is attached by any conventional means to said first rear support strap section 8, including stitching, adhesive or other attachment means. The second support strap sections 9, 10 preferably are made of a single, continuous, elastic, flexible material; optionally, said second front support strap section 9 is attached by any conventional means to said second rear support strap section 10, including stitching, adhesive or other attachment means.

The first 7 and second 9 front support strap sections preferably are connected by connecting strap 11; optionally said support strap sections are not connected. The first 8 and second 12 rear support strap sections preferably are connected by connecting strap 12; optionally said support strap sections are not connected. Said connecting straps are attached to said support strap sections by stitching, flexible adhesive or other conventional attachment means.

The football 1 may be a standard, regulation American football, or another football having a size, shape, material or other feature adapted to an individual player, including a smaller football adapted for use by a younger player. The material of the football is preferably leather, but may be plastic or plastic foam for the training of smaller or younger players.

The loops formed by the football support straps preferably have circumferences approximating the circumference of the football chosen for use for training in carrying the football, at a point midway between the enlarged midsection of the football and the pointed ends of the football.

In the most preferred embodiment of the invention, the football support straps are made of elastic, flexible polymer material and the circumferences of the loops formed by the football support straps are slightly smaller than the circumference of the football chosen for use, at a point midway between the enlarged midsection of the football and the pointed ends of the football, and the elastic loops can be stretched to insert the football, providing very secure support for the football.

The flap 17 is preferably of any strong and flexible fabric, most preferably of polyester or polyamide synthetic fabric, but may be of any leather, synthetic or natural fabric or flexible film.

The football attachment 21 may be of any strong and flexible adhesive.

The flap attachment 18 may be any conventional attachment means, preferably stitching, any strong and flexible adhesive or a combination of stitching and any strong and flexible adhesive.

In use of the preferred device, the football player inserts the football 1 into the cradle support loops and initiates the ball-carrying exercise by grasping the football 1 and pulling the football and cradle upwards towards his chest, resulting in the football 1 being positioned in a horizontal orientation at his abdomen. The player then supports the football 1, as specified by the coach or trainer, and runs towards an opposing player or line of players.

In use of the second embodiment of the device, the football player initiates the ball-carrying exercise by grasping the football 1 and pulling the football and flap upwards towards his chest, resulting in the football 1 being positioned in a horizontal orientation at his abdomen. The player then supports the football 1, as specified by the coach or trainer, and runs towards an opposing player or line of players.

Typically, the player forms a protective pocket by placing the first forearm against his lower abdomen, under the horizontally oriented football 1 and the second forearm against his upper abdomen, above the horizontally oriented football 1, and holds one end of the football 1 with each hand.

The device of the invention encourages the desired holding and carrying of the football 1, and the desired stance and posture of the player.

The location of the belt 2, 16 at the waist of the player, and the location of the attached football 1 in the cradle encourage the player to crouch to reach the football 1, and also limit the distance of the football 1 above the waist to the level of the abdomen, when the football 1 is carried. The player is thus encouraged to assume and maintain a desired crouching stance, resulting in a lowered center of gravity, greater stability and reduced vulnerability to being tackled, slowed or stopped by opposing players.

The location and horizontal orientation of the football 1 also encourages the desired formation and maintenance of a protective pocket for the football 1 by the player's arms and hands, and by the crouched posture, resulting in a reduced likelihood that opposing players can dislodge the football 1 or disrupt the player's control of the football 1.

The location and horizontal orientation of the football also encourage the desired horizontal orientation and squaring of the player's shoulders, resulting in greater stability in approaching and encountering opposing players or line of players.

The device of the invention is simple and readily portable.

It is to be understood that while certain forms of this invention have been illustrated and described, it is not limited thereto except insofar as such limitations are included in the claims and allowable functional equivalents thereof.

I claim:

1. A football carrying training aid, comprising in combination:

a football having first and second tapered ends and a central ball section progressively enlarged between the first and second ball ends, and a flexible belt of a length adapted to encircle a waist of a user, said belt having first and second ends, said first and second ends including first and second belt fasteners to removably secure said ends together, and a flexible ball holder, said ball holder comprising an upper ball cradle support designed to attach said holder to said belt, and a ball cradle portion, said ball cradle portion comprising first and second flexible straps, said first strap having first and second strap ends and said second strap having third and fourth strap ends, said strap ends fastened to said cradle support, said first and second straps forming first and second loops having circumferences no greater than circumference of said football midway between the central ball section and the first and second ball ends, said flexible ball holder having dimensions that allow said football to be raised to the level of the abdomen of said user, said flexible ball holder having dimensions that do not allow said football to be raised to a level above the abdomen of said user.

2. The device of claim 1, wherein said flexible straps are made of an elastic material.

3. The device of claim 1, wherein said first and second straps are connected by at least one connecting strap in said central ball holder section.

4. The device of claim 2, wherein said first and second straps are connected by at least one connecting strap in said central ball holder section.

5. The device of claim 1 wherein said ball cradle support includes a loop adapted to removably attach said support to said belt.

6. The device of claim 5 wherein said flexible straps are made of an elastic material.

7. The device of claim 5, wherein said first and second straps are connected by at least one connecting strap in said central ball holder section.

8. The device of claim 6, wherein said first and second straps are connected by at least one connecting strap in said central ball holder section.

9. The device of claim 1 wherein said first and second belt fasteners are made of complementary hook and loop fabric.

10. The device of claim 2 wherein said first and second belt fasteners are made of complementary hook and loop fabric.

11. The device of claim 3 wherein said first and second belt fasteners are made of complementary hook and loop fabric.

12. The device of claim 4 wherein said first and second belt fasteners are made of complementary hook and loop fabric.

13. The device of claim 5 wherein said first and second fasteners are made of complementary hook and loop fabric.

14. The device of claim 6 wherein said first and second fasteners are made of complementary hook and loop fabric.

15. A football carrying training aid, comprising in combination:

a football having first and second tapered ends and a central ball section progressively enlarged between the first and second ball ends, and a flexible belt having first and second ends, of a length adapted to encircle a waist of a user, said first and second ends including first and second belt fasteners to removably secure said ends together, and a flexible ball holder, said ball holder comprising a flexible ball support flap having upper and lower flap ends, said upper end of said flap non-removably attached to said belt midway between said first and second belt ends, said flap having front and rear surfaces, said central section of said football non-removably attached to said central section of said front surface of said flap, the axis of said first and second ends of said football aligned essentially parallel to said belt, said flexible ball holder having dimensions that allow said football to be raised to the level of the abdomen of said user, said flexible ball holder having dimensions that do not allow said football to be raised to a level above the abdomen of said user.

16. The device of claim 15 wherein said flap is attached to said belt by adhesive and said football is attached to said flap by adhesive.

17. The device of claim 16 wherein said first and second belt fasteners are made of complementary hook and loop fabric.

18. A method of training a user to hold a football for carrying, the method comprising:

providing a football, said football including first and second tapered ends and a central section progressively enlarged between the first and second ball ends, providing a flexible belt having first and second ends, of a length adapted to encircle a waist of a user, said first and second ends including first and second belt fasteners to removably secure said ends together, providing a flexible ball holder, said ball holder comprising an upper ball cradle support designed to attach said holder to said belt, and a ball cradle portion, said ball cradle portion comprising first and second flexible straps, said said first strap having first and second strap ends and said second strap having third and fourth strap ends, said strap ends fastened to said cradle support, said straps forming first and second loops having circumferences no greater than circumference of said football midway between the central ball section and the two ball ends, placing said belt around said waist of said user, said ball cradle located at said front of said user, said first and second belt fasteners located at rear of said user, fastening said first and second belt fasteners together, placing said football in said first and second ball cradle loops, positioning said football and said ball cradle leveled at said user's abdomen, wherein said football is supported by said user's first forearm positioned below said football, and wherein said football is supported by said user's second forearm positioned above said football, wherein said football remains securely in position when said user runs forward.

19. The method of claim 18 wherein said ball cradle support is adapted to removably attach said ball holder to said belt, said flexible straps are made of an elastic material and said first and second belt fasteners are made of complementary hook and loop material.

* * * * *